US005285820A

United States Patent [19]

Bassing

[11] Patent Number: 5,285,820

[45] Date of Patent: Feb. 15, 1994

[54] POWER LOOM LAY OR BATON DRIVE

[75] Inventor: Friedrich W. Bassing, Emsdetten, Fed. Rep. of Germany

[73] Assignee: Jürgens Maschinenbau GmbH & Co. KG, Emsdetten, Fed. Rep. of Germany

[21] Appl. No.: 901,246

[22] Filed: Jun. 19, 1992

[30] Foreign Application Priority Data

Jul. 5, 1991 [DE] Fed. Rep. of Germany ..... 4122249

[51] Int. Cl.[5] ..... D03D 49/60

[52] U.S. Cl. ..... 139/190; 139/188 R

[58] Field of Search ..... 139/188.12, 190, 141, 139/66 R; 29/26 R

[56] References Cited

U.S. PATENT DOCUMENTS

| | | | |
|---|---|---|---|
| 2,613,693 | 10/1952 | Jarvis | 139/66 RX |
| 3,797,363 | 3/1974 | Nohejl | 29/26 R |
| 3,822,726 | 7/1974 | Kuster et al. | 139/190 |
| 3,964,524 | 6/1976 | Benedict | 139/190 |
| 4,957,143 | 9/1990 | Takahashi et al. | 139/190 |
| 4,986,315 | 1/1991 | Borisch et al. | 139/66 R |

FOREIGN PATENT DOCUMENTS 0321974 6/1987 European Pat. Off. .

*Primary Examiner*—Andrew M. Falik
*Attorney, Agent, or Firm*—Michael J. Striker

[57] ABSTRACT

A power loom, particularly for weaving of sieves or screen fabrics, has a fabric batton, a fabric batton drive, a shaft drive, and a shuttle drive. The fabric batton drive includes a program-controlled servo motor, and a transmission located between the servo motor and the fabric batton.

7 Claims, 2 Drawing Sheets

POWER LOOM LAY OR BATON DRIVE

BACKGROUND OF THE INVENTION

The present invention relates to a power loom. More particularly, it relates to a power loom for weaving of sieves or screens which has a fabric batton drive, a shaft (dobby) drive, and a shuttle drive.

Power looms of the above mentioned general type are used for producing fabrics of different widths and lengths. The productivity of these machines is determined substantially by the number of battons. It cannot be increased arbitrarily since for introducing of the weft thread between the warp threads a sufficient time must be available. It is required to correspondingly orient the warp and weft threads depending on predetermined application of the fabric. For woven paper machine sieves the dimensions are needed, which are longer in the direction of the weft thread than in the direction of the warp threads. This of course also influences the dimensions of the power looms which for such applications must have loom widths of 30 m. For introducing such long weft threads, a sufficient time must be available during a working cycle of the fabric batton. Correspondingly, the maximum possible batton number is limited. Moreover, the mass of the fabric batton must be moved. This mass grows proportionally with the fabric width and therefore additionally limits the possible batton number.

For increasing the productivity and avoiding the disadvantages connected with higher batton number, it has been proposed in the European patent document EP 0,321,274 to design a fabric batton drive for a power loom, which has a toggle lever moved by a complementary cam drive and articulately connected with a machine frame on the one hand and with the fabric batton support on the other hand. Due to the complementary cam drive the batton support performs a non-uniform swinging movement which provides more time for the weft thread introduction during a working cycle. The cam control of the fabric batton drive has however a disadvantage that when the number of battons is increased the rollers have the tendency for lifting from the cam disc and due to the mass moment of inertia disadvantageous reverse cycles are produced. Other known constructions involve providing a non-uniform movement of the fabric batton by the use of elliptic gear wheels or special crank drives.

SUMMARY OF THE INVENTION

Accordingly, it is an object of the present invention to provide a power loom which avoids the disadvantages of the prior art.

More particularly, it is an object of the present invention to provide a power loom which has an increased productivity.

In keeping with these objects and with others which will become apparent hereinafter, one feature of the present invention resides, briefly stated, in a power loom in which the fabric batton drive has a program-controlled servo motor, and a self-locking transmission is arranged between the servo motor and the fabric batton. Such a self-locking transmission can be formed for example as a known cam drive. In a unexpected manner it has been shown that by superimposing the speed control by the cam drive with the additional control by a servo motor the mechanical limits for the existing speed control with the fabric batton can be exceeded and therefore higher batton numbers can be obtained, which lead to an improved productivity of the power loom.

In a unexpected manner, the whole cam drive can be replaced with by a worm transmission with further transmission stages. Therefore the working cycle of the fabric batton can be influenced in connection with the program control by a simple reprogramming.

A drive can be provided on both ends of the fabric batton. Thereby the fabric batton can be driven symmetrically. The inertia-caused distortions of the fabric batton are therefore avoided.

The same objective is achieved with the means for synchronization of both drives and means for comparing the servo motor moments. As a result the precision of the movement is therefore improved.

In order to monitor the fabric batton movement, the power loom is provided with sensors which preferably are formed as absolute value decoders.

By the control, the other movements such as of the dobby mechanism and the shuttle pick can be locked with the fabric batton movement and operational disturbances can be avoided.

A further optimization of the movement cycle can be obtained when the shaft (dobby) drive has a servo motor.

In accordance with a further embodiment of the present invention, the drive can be formed as a leading drive. The deviations detected by the control are always obtained as difference between nominal and actual values for producing corresponding corrected adjusting values, with respect to the leading drive.

The interface for an electronic control can be provided with smaller means when the servo motor is formed as an electric servo motor.

Alternatively, it is possible that the servo motor is formed as a hydraulically actuated servo motor, for example an axial piston pump. The axial piston pump has the advantage that a self-locking transmission can be dispensed with.

The objective of the present invention is achieved when a program-controlled servo motor in a power loom is provided as a drive for a fabric batton in connection with a self-locking transmission.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
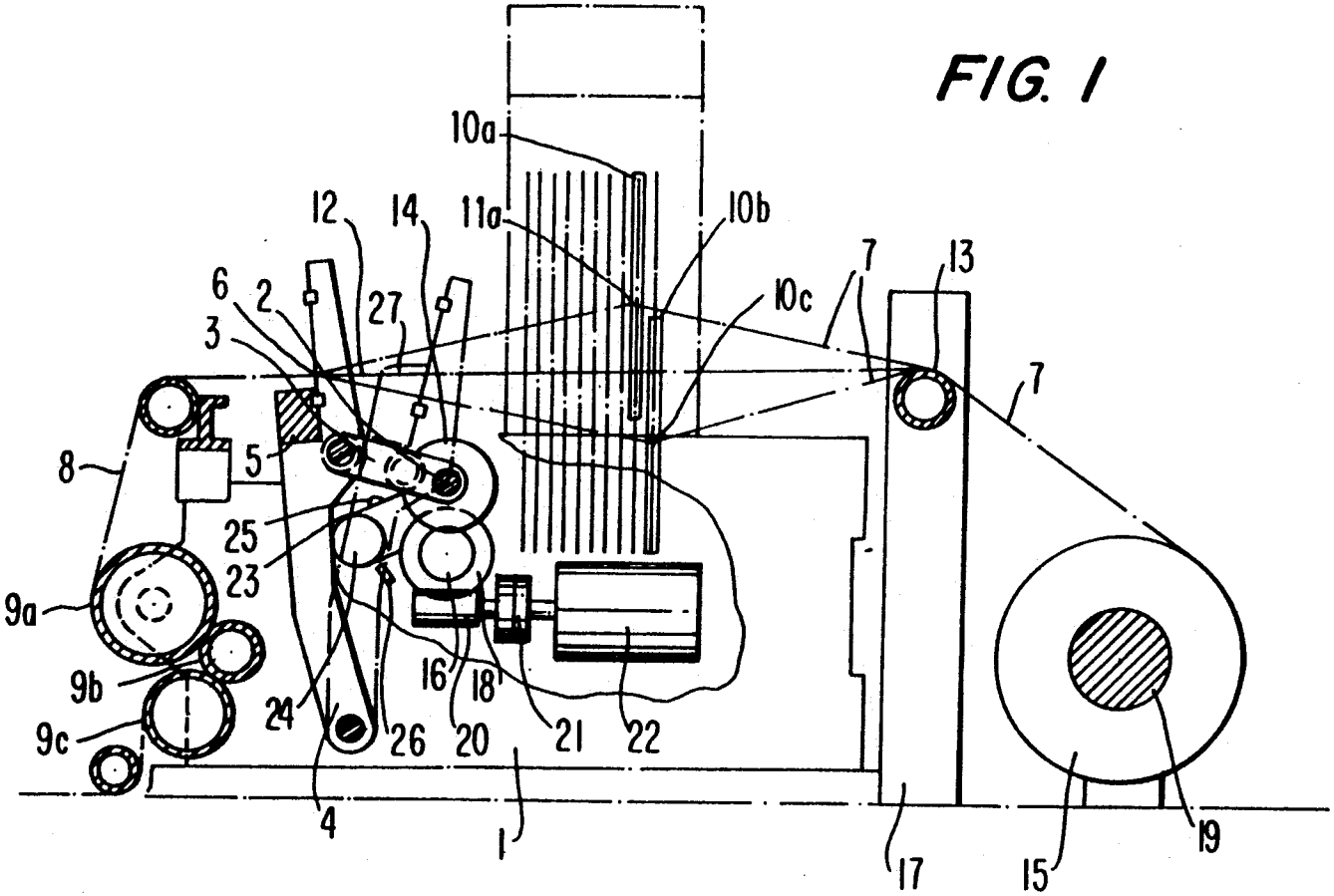
FIG. 1 of the drawings is a view schematically showing a cross-section through a power loom with a mounted drive for a fabric batton.
Figure 2:
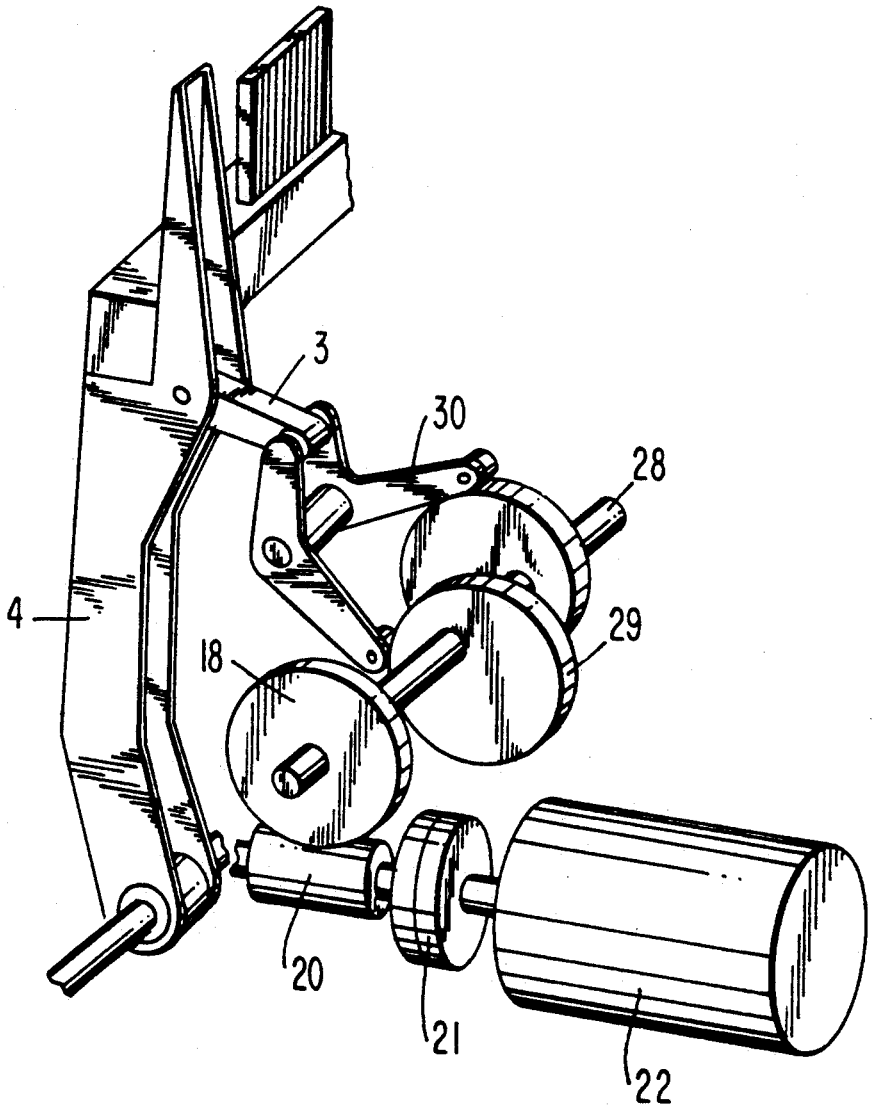
FIG. 2 is a perspective enlarged view of a part of the inventive power loom.

A power loom shown in FIG. 1 has a frame wall 1, a crankshaft 2, a crank rod 3, a slaysword 4, a fabric batton or lay 5, and a fabric sheet 6 through which warp threads 7 are pulled. A woven product 8 is constantly pulled by three fabric beams 9*a*, 9*b*, 9*c* through a not shown fabric beam regulator in each working cycle of the power loom by an exactly identical piece. A not shown shaft (dobby) mechanism moves the fabric shafts 10 and 10*b* with heddles 11*a* and 11*b*. The warp threads 7 run through the eyes and thereby form a shed 12 in which the weft threads are introduced by a not shown shuttle. At the rear side of the frame wall 1 a supporting element 13 is provided for guiding the warp threads 7 coming from the warp beam 15. The warp beam 15 is supported in bearings 19 and is driven by a not shown motor.

A drive for the crankshaft 2 is shown schematically inside the broken line for the frame wall 1. A spur wheel 14 is fixedly connected with the crankshaft 2 and engages with a pinion 16. The pinion 16 is turn is fixedly connected with a worm wheel 18 which engages a worm shaft 20. The axle of the worm shaft 20 is connected with the axle of the servo motor 22 by a coupling 21. By means of the coupling 21 the driving moment can be outputted from the servo motor 22 through the above described transmission train to the crankshaft 2.

The servo motor 22 transmits its rotary movement through the coupling 21 to the worm shaft 20 which engages with the worm wheel 18, which in turn is mounted on a worm wheel shaft 28. A cam 29 which is also mounted on the worm wheel shaft transmits its stroke to a roller lever 30 and then through the crank rod 3 to the slay sword 4 to impart reciprocating swinging motion to the same.

The position of the crankshaft 2 is obtained by a not shown gear wheel which is coaxial to the crankshaft 2 and fixedly connected with it. A toothed belt 23 is arranged on this toothed wheel and on a further toothed wheel 24. A mark 25 is mounted on the toothed belt 23. It is detected by a sensor 26 and converted into a corresponding signal which is supplied through a not shown conduit to a not shown control.

The above described arrangement can be provided at both sides of the power loom. One drive can be formed as a leading drive while another drive can be formed as a following drive. The uniform moment introduction to the crank shaft is monitored with the electrical servo motors by comparison of the motor current and regulated by the control when needed. The exact synchronization of the both-side drives is performed by the control by the signals of the sensors 26.

In this manner a precisely operating fabric batton drive is possible, with higher frequencies of the working cycle than in previously existing power looms and without disadvantageous increase of the shuttle speed.

It will be understood that each of the elements described above, or two or more together, may also find a useful application in other types of constructions differing from the types described above.

While the invention has been illustrated and described as embodied in a power loom, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A power loom, comprising a fabric batton; a fabric batton drive including a program-controlled servo motor operative for driving said fabric batton to make said fabric batton swing; and a transmission located between said servo motor and said fabric batton and formed as a self-locking transmission.

2. A power loom as defined in claim 1, wherein said self locking transmission is formed as a worm transmission.

3. A power loom as defined in claim 1, wherein said servo motor is formed as an electric servo motor.

4. A power loom as defined in claim 1; and further comprising sensing means for monitoring a movement of said fabric batton.

5. A power loom comprising a fabric batton; a fabric batton drive including a program-controlled servo motor operative for driving said fabric batton to make said fabric batton swing; and a transmission located between said servo motor and said fabric batton, said transmission being formed as a cam drive.

6. A power loom comprising a fabric batton; a fabric batton drive including a program-controlled servo motor operative for driving said fabric batton to make said fabric batton swing; and a transmission located between said servo motor and said fabric batton, said fabric batton having two ends, said fabric batton drive being arranged at said two ends of said fabric batton.

7. A power loom comprising a fabric batton; a fabric batton drive including a program-controlled servo motor operative for driving said fabric batton to make said fabric batton swing; and a transmission located between said servo motor and said fabric batton, said fabric batton having two ends, said fabric batton drive being arranged at said two ends of said fabric batton, said transmission being formed as a worm transmission.

* * * * *